US006885270B2

(12) United States Patent
Buswell

(10) Patent No.: US 6,885,270 B2
(45) Date of Patent: Apr. 26, 2005

(54) WIRE CORE INDUCTIVE DEVICES HAVING A BIASSING MAGNET AND METHODS OF MAKING THE SAME

(76) Inventor: Harrie R. Buswell, 132 Lorraine Ct., Berea, KY (US) 40403

( * ) Notice: Subject to any disclaimer, the term of this patent is extended or adjusted under 35 U.S.C. 154(b) by 61 days.

(21) Appl. No.: 10/470,004

(22) PCT Filed: Jan. 23, 2002

(86) PCT No.: PCT/US02/01664

§ 371 (c)(1),
(2), (4) Date: Jul. 23, 2003

(87) PCT Pub. No.: WO02/059915

PCT Pub. Date: Aug. 1, 2002

(65) Prior Publication Data

US 2004/0051617 A1 Mar. 18, 2004

Related U.S. Application Data

(60) Provisional application No. 60/263,637, filed on Jan. 23, 2001.

(51) Int. Cl.[7] ..... H01F 27/02
(52) U.S. Cl. ..... 336/83; 336/233; 29/602.1
(58) Field of Search ..... 336/83, 233, 60, 336/234, 229; 29/602.1, 606

(56) References Cited

U.S. PATENT DOCUMENTS

| | | | | |
|---|---|---|---|---|
| 1,597,901 A | | 8/1926 | Kent | 333/177 |
| 2,043,346 A | | 6/1936 | Buckley | 178/46 |
| 2,179,661 A | | 11/1939 | Jones | 171/119 |
| 3,304,599 A | | 2/1967 | Nordin | 29/155.57 |
| 3,350,670 A | | 10/1967 | Strauch | 336/90 |
| 3,720,897 A | | 3/1973 | Feather et al. | 336/60 |
| 4,035,751 A | | 7/1977 | Walthew | 336/60 |
| 4,415,841 A | * | 11/1983 | Willis et al. | 315/400 |
| 4,504,750 A | * | 3/1985 | Onodera et al. | 310/12 |
| 6,239,681 B1 | | 5/2001 | Buswell | 336/83 |
| 6,268,786 B1 | | 7/2001 | Buswell | 336/83 |

* cited by examiner

*Primary Examiner*—Anh Mai
(74) *Attorney, Agent, or Firm*—Miles & Stockbridge P.C.

(57) ABSTRACT

An inductive device comprises a magnetic core including a portion of a plurality of wires, at least one electric winding extending around the magnetic core, each of the plurality of wires substantially encircling the at least one electric winding, and at least one biassing magnet disposed adjacent the plurality of wires to provide a bias magnet flux for offsetting a flux generated by a direct current component flowing in the winding.

40 Claims, 4 Drawing Sheets

WIRE CORE INDUCTIVE DEVICES HAVING A BIASSING MAGNET AND METHODS OF MAKING THE SAME

CROSS REFERENCE TO RELATED APPLICATIONS

This application claims the benefit of provisional Application No. 60/263,637, filed on Jan. 23, 2001, which is incorporated herein by reference.

BACKGROUND OF THE INVENTION

1. Field of the Invention

The present invention relates to the field of inductive devices, and more particularly to wire core inductive devices such as transformers, chokes, coils, ballasts, and the like.

2. Description of Related Art

It is common for low frequency application transformers and other inductive devices to be made up of a magnetic core comprising a plurality of sheets of steel, the sheets being die cut and stacked to create a desired thickness of the core. For many years, the thickness (thus number of necessary pieces) of the stampings has been determined by a strict set of constraints, e.g. magnitude of eddy currents versus number of necessary pieces. The individual sheets of selected thickness are oxide-coated, varnished or otherwise electrically insulated from one another in order to reduce/minimize eddy currents in the magnetic core.

The present inventor has developed wire core inductive devices such as transformers, chokes, coils, ballasts, and the like having a magnetic core including a portion of a plurality of wires rather than the conventional sheets of steel. The ends of the plurality of wires extend around the electrical windings and are arranged to substantially complete a magnetic circuit or flux path. These devices and related methods of manufacturing these devices are set forth in detail in U.S. Pat. Nos. 6,239,681 and 6,268,786, which are incorporated herein by reference. One important aspect of these devices is the provision of an increased operating frequency span enabling higher operating frequencies over conventional E/I type units. These increased operating frequencies approach those previously only efficiently and effectively reached by switch-mode power supplies, inverters, and converters which contained molded core type transformers.

A magnetic core of an inductive device will reach a magnetic saturation point when a sufficient magnetic force is applied to the core by current flowing through windings extending around the core. Saturation of the core is often a non-desirable condition because the inductance provided by the device drops drastically. In applications where a direct current component is present in a current flowing in a winding of an inductive device, the core will reach saturation more rapidly because the direct current component provides a magnetic bias.

SUMMARY OF THE INVENTION

This invention provides a wire core inductive device that includes a biassing magnet to provide a bias magnetic flux. The bias magnetic flux offsets a flux component generated by a direct current component of a current flowing in one or more windings around the core. The biassing magnet thereby allows saturation of the magnetic core to occur at a higher current level. Accordingly, the useful range of the wire core inductive device is improved over a similar inductive device without the biassing magnet. In a preferred embodiment, the biassing magnet is a permanent magnet, which is also highly electrically resistive (to reduce eddy currents).

Thus, awarding to one of its principal aspects, the present invention provides an inductive device having a magnetic core including a portion of a plurality of wires, at least one electric winding extending around the magnetic core with each of the plurality of wires substantially encircling the at least one electric winding and completing a magnetic circuit, and at least one biassing magnet disposed adjacent to the plurality of wires and applying a magnetic bias to the magnetic circuit.

According to another of its principal aspects, the present invention provides a method for making an inductive device, comprising the steps of providing a magnetic core including a portion of a plurality of wires, winding at least one electric winding around the magnetic core, configuring each of the plurality of wires so as to substantially encircle the at least one electric winding and complete a magnetic circuit, and providing at least one biassing magnet adjacent to the plurality of wires to apply a magnetic bias to the magnetic circuit.

In preferred embodiments, the electric windings are either wound directly onto the magnetic core or are wound separately and slipped over an end of the core, and the inductive device includes a biassing magnet, which is slipped over the end of the magnetic core. The ends of the wires forming the magnetic core are spread and configured to substantially encircle the electric windings and the biassing magnet, forming a complete magnetic circuit. A band or other connector means holds the ends of the wires together. Advantageously, the wires configured in this manner envelop the electric windings and the biassing magnet to provide a shield substantially containing the electromagnetic fields emanating from the device and reducing the intrusion of electromagnetic fields from external sources. The shielded inductive device may include at least one additional magnet positioned adjacent the plurality of wires to further enhance the offsetting bias of the biassing magnet.

A preferred embodiment of a method of making an inductive device according to this invention, includes providing a magnetic core formed from a plurality of wires, placing at least one electric winding along the length of the core, providing at least one permanent magnet adjacent to the core, and configuring the plurality of wires to substantially envelop the at least one electric winding and biassing magnet and form a complete a magnetic circuit.

BRIEF DESCRIPTION OF THE DRAWINGS

The foregoing and other aspects, features and advantages of this invention will be more appreciated from the following detailed description of the preferred embodiments with reference to the accompanying drawings, wherein.

DETAILED DESCRIPTION OF THE PREFERRED EMBODIMENTS

Figure 1:
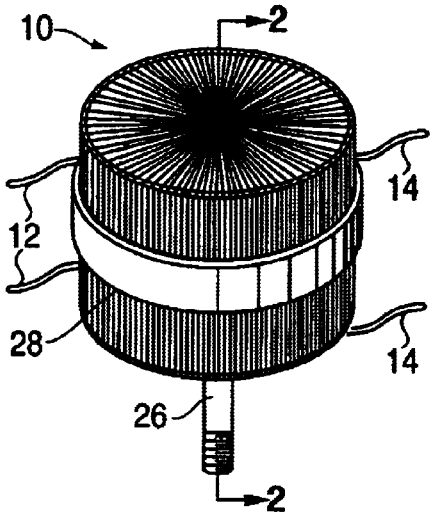
FIG. 1 is a perspective view of an inductive device according to a preferred embodiment of the invention.

FIG. 1 shows an inductive device 10 according to a preferred embodiment of the invention. In this embodiment, the inductive device 10 is a transformer. However, it should be appreciated that the principles of this invention are applicable to a variety of inductive devices, such as, but not limited to: transformers and coils (chokes, reactors, etc.) both of types that utilize core saturation (saturable transformers, magnetic amplifiers, saturable reactors, swinging chokes, etc.) and those that do not, as well as AC applications of solenoids, relays, contactors, and linear and rotary inductive devices.

The inductive device 10 includes leads 12 for connecting a power source (not shown) to a primary winding of the inductive device 10. The inductive device 10 also includes leads 14 for connecting a secondary winding to a load (not shown). Those skilled in the art will realize that the designation of the primary and secondary windings is somewhat arbitrary, and that one may use the leads 14 for connection to the primary winding, and the leads 12 for connection to the secondary winding. The designations of "primary" and "secondary" are therefore used herein as a convenience, and it should be understood that the windings are reversible.

Figure 2:
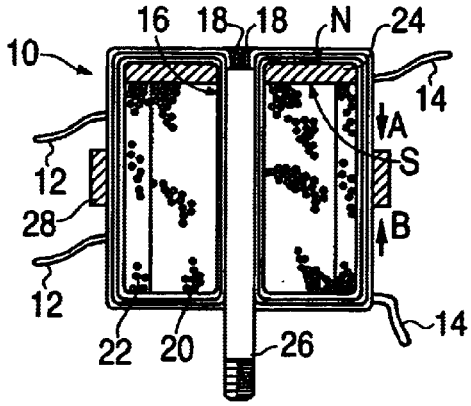
FIG. 2 is a cross-sectional view of the inductive device taken along line II—II in FIG. 1.

FIG. 2 is a cross-sectional view of the inductive device 10 taken along the line II—II in FIG. 1. The inductive device 10 includes a magnetic core 16 formed of a plurality of wires 18. The electric windings 20 and 22 extend around the magnetic core 16. In this exemplary embodiment, the electric winding 22 also extends around the electric winding 20.

A biassing magnet 24 is slipped over the end of the magnetic core 16. In this embodiment, the biassing magnet 24 is a permanent magnet. Further, the biassing magnet 24 is ring shaped. It should be appreciated that in other embodiments, the biassing magnet may be an electromagnet or a combination of a permanent magnet and an electromagnet.

The plurality of wires 18 utilized to form the magnetic core 16 extend outwardly therefrom and are further formed to encircle electric windings 20 and 22 and the biassing magnet 24 so as to complete a magnetic circuit The ends of the plurality of wires 18 meet, and are held together by a band 28 or the like. The leads 12 and 14 pass between the plurality of wires 18 to connect to the electric windings 20 and 22, respectively. Alternatively, the ends of the plurality of wires 18 may be joined above or below the magnetic core 16 or additional wires (not shown) may be used to join the end of the plurality of wires 18.

The wires 18 form a shield that substantially contains electromagnetic fields emanating from the inductive device 10 and that also reduces the intrusion of electromagnetic fields including electromagnetic interference and/or magnetic flux from external sources.

The biassing magnet 24 is arranged on the core, so that it provides a magnetic bias to the magnetic circuit (indicated by arrows A) to offset a magnetic bias generated by a direct current component flowing through either or both of the windings 20 and 22 (indicated by arrows B). It will be appreciated that reversing the polarity of the biassing magnet 24 can reverse the offsetting magnetic bias.

The inductive device 10 also includes a mounting post 26 and a band 28 as shown and described in the aforementioned U.S. Pat. Nos. 6,239,681 and 6,268,780.

Figure 3:
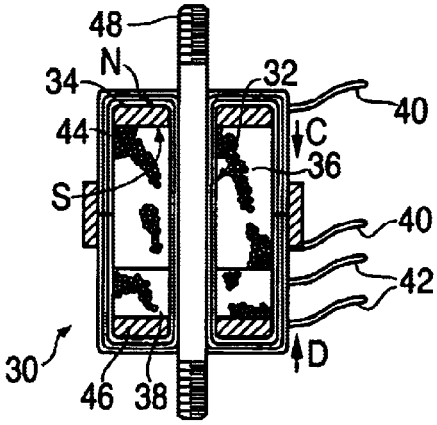
FIG. 3 is a cross-sectional view similar to FIG. 2 but showing an inductive device according to an alternative embodiment of the invention, wherein electric windings are axially displaced from each other on the magnetic core and two permanent magnetic rings are disposed at opposite ends of the magnetic core.

FIG. 3 is a cross-sectional view similar to FIG. 2, but shows an inductive device 30 according to an alternative embodiment of this invention. The inductive device 30 is similar to the inductive device 10, in that it includes a magnetic core 32 formed of a portion of a plurality of wires 34 and electrical windings 36 and 38, which extend around the magnetic core 32. The plurality of wires encircle the windings 36 and 38, completing a magnetic circuit. Leads 40 and 42 connect to windings 36 and 38, respectively. Similar to the inductive device 10, a biassing magnet 44 is disposed adjacent to the plurality of wires 34. The biassing magnet 44 is a permanent magnet.

The electrical windings 36 and 38 are positioned axially beside one another on magnetic core 32, rather than concentrically as in the inductive device 10 of FIG. 2. In addition, a second biassing magnet 46 is provided. The second biassing magnet 46 is also a permanent magnet.

The biassing magnet 44 and the second biassing magnet 46, both of which are ring shaped, are slipped over opposite ends of the magnetic core 32. The plurality of wires 34 substantially encircle the windings 36 and 38 as well as the biassing magnets 44 and 46. The biassing magnets 44 and 46 provide a combined offsetting magnetic bias (indicated by arrows C) to counteract a bias produced by a direct current (indicated by arrows D).

The inductive device includes a mounting post 48 that extends axially from the magnetic core 32 at one end.

Figure 4:
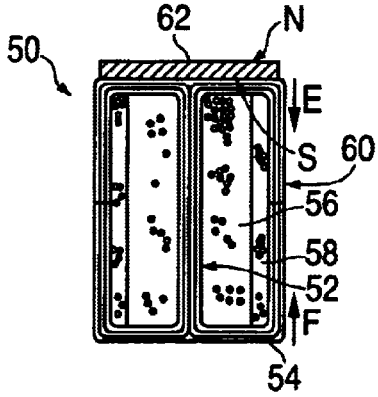
FIGS. 4–9 are cross-sectional views showing, in more diagrammatic form, alternative embodiments of inductive devices according to the present invention.

FIG. 4 is a cross-sectional view of an inductive device 50 according to an alternative embodiment of the present invention. The inductive device 50 includes a magnetic core 52 that is formed of a portion of a plurality of wires 54. A primary winding 56 and a secondary winding 58 are wrapped around the magnetic core 52. As in the above embodiments, the plurality of wires 54 encircle the windings 56 and 58 so as to form a complete magnetic circuit and provide an electromagnetic shield 60.

In the present embodiment, a biassing magnet 62 is disposed at one end of the inductive device 50. The biassing magnet 62 is a permanent magnet that is substantially non-electrically conductive (to reduce eddy currents). It should be appreciated that in other embodiments, the biassing magnet 62 may be an electromagnet or a combination of a permanent magnet and an electromagnet. The biassing magnet 62 is disposed on an outer surface of the plurality of wires 54. The biassing magnet 62 substantially covers an end of the inductive device 50. However, it should be appreciated that the biassing magnet 62 may cover only a portion of the end depending upon the requirements of the particular application. The biassing magnet 62 is arranged on the device 50 so that it provides a magnetic bias, (indicated by arrows E) to offset a magnetic bias that is introduced when a direct current component flows through any of the windings 56 and 58 (indicated by arrows F).

The biassing magnet 62 is disc shaped in this embodiment. However, it should be appreciated that the biassing magnet 62 may be other shapes such as, but not limited to, ring, cylindrical or rectangular. It should further be appreciated that in other embodiments, the biassing magnet 62 may include or be replaced by a plurality of biassing magnets.

Figure 5:
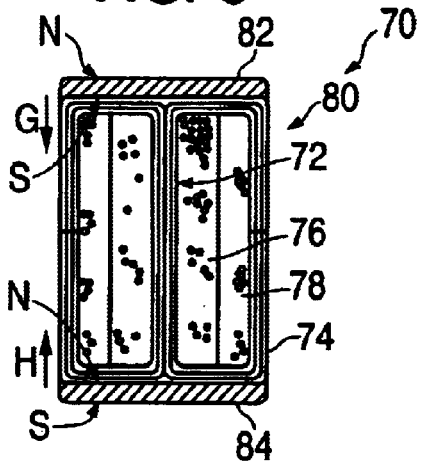

FIG. 5 is a cross-sectional view of an inductive device 70 according to another embodiment of this invention. The inductive device 70 includes the magnetic core 72 that includes a portion of a plurality of wires 74. The device 70 also includes a primary winding 76 and secondary winding 78 wrapped around the magnetic core 72. The plurality of wires 74 substantially encircle the windings 76 and 78 so as to complete a magnetic circuit and provide an electromagnetic shield 80. Inductive device 70 also includes a first biassing magnet 82 and a second biassing magnet 84 disposed at opposite ends of the inductive device 70. The biassing magnets 82 and 84 are disposed on an outer surface of the plurality of wires 74. The biassing magnets 82 and 84 are disc shaped and in this embodiment, they are permanent magnets. However, it should be appreciated that the biassing magnets 82 and 84 may be other shapes such as, but not limited to, ring, cylindrical, or rectangular. It should further be appreciated that in other embodiments, either or both biassing magnets 82 and 84 may be replaced with plurality of biassing magnets. The biassing magnets 82 and 84 provide a combined offsetting magnetic bias (indicated by arrows G) to counteract a bias produced by a direct current (indicated by arrows H) flowing in one of the windings.

Figure 6:
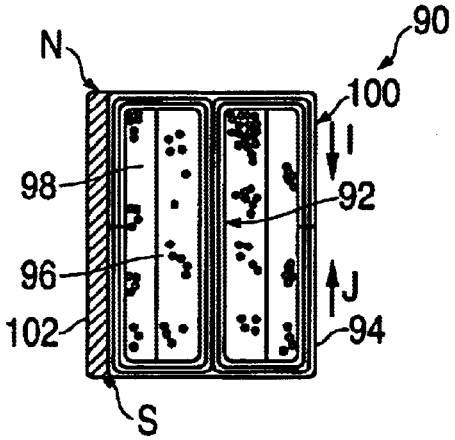

FIG. 6 is a cross-sectional view of an inductive device 90 according to another alternative embodiment of the present invention. The inductive device 90 is similar to the inductive device 60 in that it includes a magnetic core 92 formed of a portion of a plurality of wires 94. The inductive device 90 also includes a primary winding 96 and a secondary winding 98 disposed around the core 92. The plurality of wires 74 substantially encircle the windings 96 and 98 so as to complete a magnetic circuit and provide an electromagnetic shield 100. The inductive device further includes a biassing magnet 102. The biassing magnet 102 is disposed adjacent to the shield 100. In this embodiment, the biassing magnet 102 is a permanent magnet and is disposed substantially parallel to the magnetic core 92. The biassing magnet 102 extends partially around the shield 100, but may extend substantially around the shield 100. The biassing magnet 102 is preferably shaped to conform to the contour of the shield. However, this is not strictly necessary. It should further be appreciated that in other embodiments, the magnetic element 102 may include or be replaced by a plurality of magnetic elements.

The biassing magnet 102 is arranged on the device 90, so that it provides a magnetic bias (indicated by arrows I) to offset a magnetic bias that is introduced when a direct current component flows through either of the windings 96 and 98 (indicated by arrows J). It will be appreciated that reversing the polarity of the biassing magnet 102 can reverse the offsetting magnetic bias.

Figure 7:
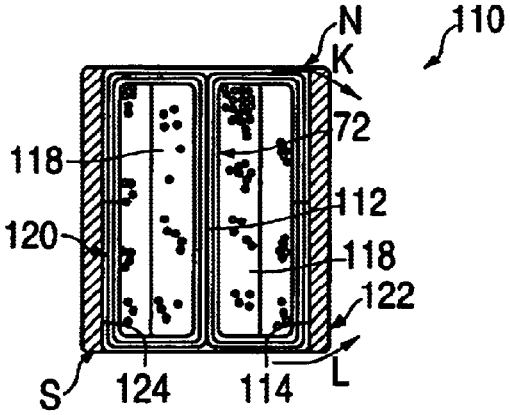

FIG. 7 is a cross-sectional view of an inductive device 110 accordingly to another alternative embodiment of the present invention. The inductive device 110 is similar to the previous embodiments of inductive devices in that it includes a magnetic core 112 formed of a portion of a plurality wires 114. The plurality of wires 114 encircle a primary winding 116 and a secondary winding 118 disposed around the magnetic core 112. The plurality wires 114 form a magnetic circuit and an electromagnetic shield 120. The inductive device 110 further includes a biassing magnet 122, which is a permanent magnet in this embodiment. The biassing magnet 122 is a hollow cylinder having an interior space 124. The magnetic core 112, the primary winding 116, the secondary winding 118, and the shield 120 are substantially disposed within the interior space 124. The biassing magnet 122 is arranged so that it provides a magnetic bias (indicated by arrows K) to offset a magnetic bias that is introduced when a direct current component flows through either of the windings 116 and 118 (indicated by arrows L). It will be appreciated that reversing the polarity of the biassing magnet 122 can reverse the offsetting magnetic bias.

Figure 8:
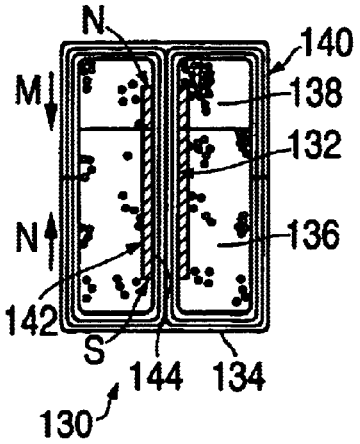

FIG. 8 is a cross-sectional view of an inductive device 130 of an alternative embodiment of the present invention. The inductive device 130 is similar to the previous inductive devices as referenced above in that it includes a magnetic core 132 formed of a portion of a plurality of wires 134, a primary winding 136, a secondary winding 138, a shield 140, and a biassing magnet 142. The plurality of wires 134 at least partially encircle the windings 136 and 138 and the biassing magnet 142, to complete a magnetic circuit and to form the shield 140. The biassing magnet 142 is a permanent magnet.

The biassing magnet 142 in this embodiment is a hollow cylinder having an interior space 144. The magnetic core 132 extends through the interior space 144. The electric windings 136 and 138 are disposed around the biassing magnet 142. The biassing magnet 142 is arranged adjacent the plurality of wires 134 so that it provides a magnetic bias (indicated by arrows M) to offset a magnetic bias that is introduced when a direct current component flows through either of the windings 136 and 138 (indicated by arrows N). It will be appreciated that reversing the polarity of the biassing magnet 142 can reverse the offsetting magnetic bias.

Figure 9:
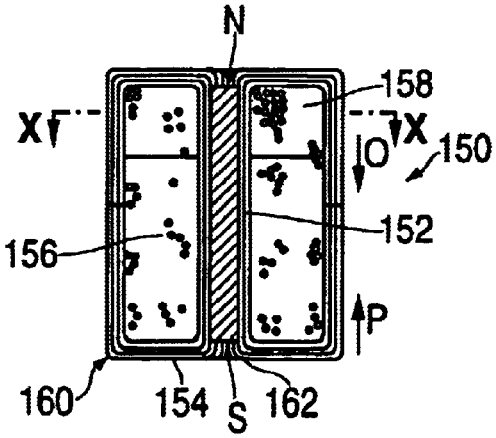

FIG. 9 is a cross-sectional view of an inductive device 150 of another alternative embodiment of the present invention. The inductive device 150 is similar to the above reference inductive devices in that it includes a magnetic core 152 formed of a portion of a plurality of wires 154, a primary winding 156, a secondary winding 158, an electromagnetic shield 160 and a biassing magnet 162, with the plurality of wires 154 at least partially encircling the windings 156 and 158 so as to complete a magnetic circuit and form the shield 160.

Figure 10:
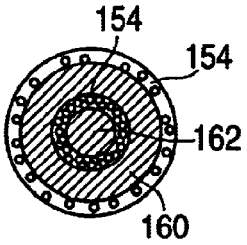
FIG. 10 is a cross-sectional view taken along line X—X of FIG. 9.

The biassing magnet 162 in this embodiment is a permanent magnet in the form of a bar. The biassing magnet 162 is disposed among the wires of the magnetic core 152. In this exemplary embodiment, the portions of the plurality of wires that make up the magnetic core 152 are disposed along outer surface of the biassing magnet 162, as shown in FIG. 10, which is a cross-sectional view taken along line X—X in FIG. 9. The biassing magnet 162 is a cylinder in this embodiment.

The biassing magnet 162 is arranged adjacent the plurality of wires 154, so that it provides a magnetic bias (indicated by arrows O) to offset a magnetic bias that is introduced when a direct current component flows through either or both of the windings 156 and 158 (indicated by arrows P). It will be appreciated that reversing the polarity of the biassing magnet 162 can reverse the offsetting magnetic bias.

Figure 11:
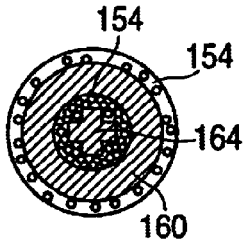
FIGS. 11–13 are similar to the cross-sectional view of FIG. 10, but show alternative cross-sectional shapes for a permanent magnet disposed among wires of a magnetic core.
Figure 12:
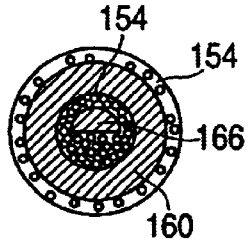
Figure 13:
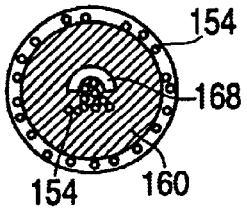

FIGS. 11 through 13 show other cross-sectional shapes of magnetic elements that may be utilized in the inductive device 150 in place of magnetic element 162. FIG. 11 shows a biassing magnet 164 having a cross shape. FIG. 12 shows a biassing magnet 166 having a semi-circular shape, and FIG. 13 displays a biassing magnet 168 having a U-shape. It should be appreciated that the biassing magnet of the inductive device 150 may be any one of a variety of different shapes in other embodiments.

Figure 14:
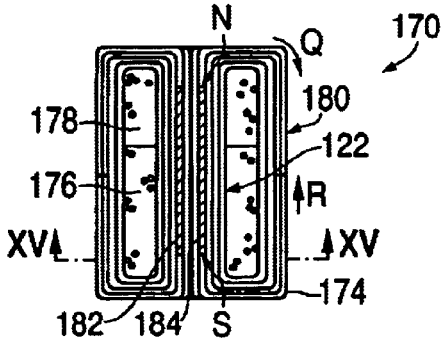
FIG. 14 is a cross-sectional view showing, in more diagrammatic form, yet another embodiment of an inductive device according to the present invention.

FIG. 14 is cross-sectional view of an inductive device 170 according to another embodiment of the present invention. The inductive device 170 is similar to the inductive devices referenced above, in that it includes a magnetic core 172 formed of a portion of a plurality of wires 174, a primary winding 176, a secondary winding 178, an electromagnetic shield 180 and a biassing magnet 182, which is a permanent magnet. The plurality of wires 174 at least partially encircle the windings 176 and 178 so as to complete a magnetic circuit and form the shield 180.

Figure 15:
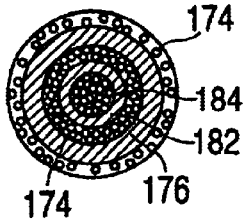
FIG. 15 is a cross-sectional view taken along line XV—XV of FIG. 14.

The biassing magnet 182 is a hollow cylinder having an interior space 184. The biassing magnet 182 is disposed along the portion of the plurality of wires that make up the magnetic core 172, and at least part of the magnetic core extends through the interior space 184 with the other wires of the core being disposed along the outer surface of the biassing magnet 182. The hollow-cylindrical shape of the biassing magnet 182 is illustrated in FIG. 15, which is a cross-sectional view taken along line XV—XV in FIG. 14.

The biassing magnet 182 is arranged adjacent the plurality of wires 174, so that it provides a magnetic bias (indicated by arrows Q) to offset a magnetic bias that is introduced when a direct current component flows through either or both of the windings 176 and 178 (indicated by arrows R). It will be appreciated that reversing the polarity of the biassing magnet 182 can reverse the offsetting magnetic bias.

Figure 16:
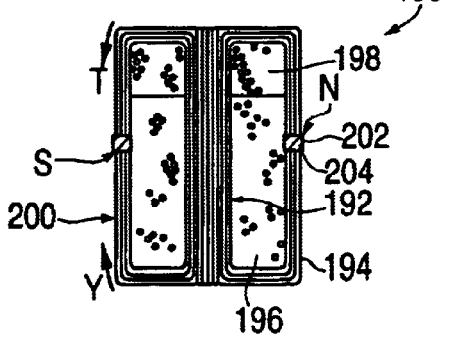
FIG. 16 is a cross-sectional view showing, in more diagrammatic form, another embodiment of an inductive device according to the present invention.

FIG. 16 is a cross-sectional view of an inductive device 190 according to another alternative embodiment of the present invention. The inductive device 190 is similar to the above-described inductive devices in that it includes a magnetic core 192 formed of a portion of a plurality of wires 194, a primary winding 196, a secondary winding 198, an electromagnetic shield 200 and a biassing magnet 202. The plurality of wires 194 each have first and second ends and partially encircle the windings 196 and 198, with the first and second ends of each wire facing each other across a gap 204. The plurality of wires 194 complete a magnetic circuit and form the shield 200.

In this embodiment, the gap 204 has a predetermined width and the biassing magnet 202 is configured to be substantially disposed in the gap 204. The biassing magnet 202 in this embodiment may, but need not extend completely around the shield 200. It should further be appreciated that the biassing magnet 202 can be replaced with a plurality of biassing magnets.

The biassing magnet 202 is a permanent magnet and is arranged adjacent the plurality of wires 194, so that it provides a magnetic bias (indicated by arrows T) to offset a magnetic bias that is introduced when a direct current component flows through either or both of the windings 196 and 198 (indicated by arrows Y). It will be appreciated that reversing the polarity of the biassing magnet 202 can reverse the offsetting magnetic bias.

Figure 17:
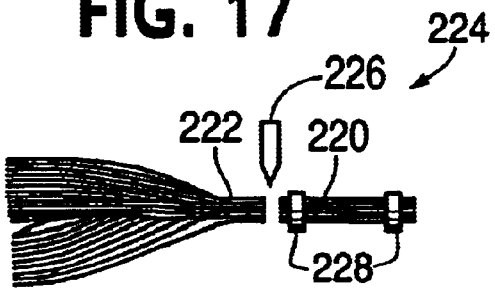
FIG. 17 is an illustration for explaining a method according to a preferred embodiment of the invention including forming a magnetic core by gathering a plurality of wires pulled from a creel to form a bundle, securing the wires with bands, and severing the bundled wires.

The use of a plurality of wires to form a magnetic core yields an efficient method for making an inductive device as set forth in the earlier mentioned patents. In accordance with a preferred embodiment of a method of this invention, FIG. 17 shows a step of providing a magnetic core 220, which includes gathering a plurality of wires 222 from a creel (not shown) to form a bundle 224, and severing the bundle at a predetermined length with a knife 226 or the like. The resulting magnetic core 220 is initially held together by bands 228 or the like. The plurality of wires 222 pulled from the creel may all be the same diameter or may be a combination of different diameters. Additionally, the plurality of wires 222 may all have the same cross-sectional shape or may be a combination of different cross-sectional shapes. The use of different diameter wires and/or cross-sectional shapes allows for a more dense packing of the magnetic core 220, thereby improving its magnetic characteristics.

Figure 18:
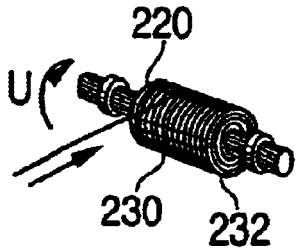
FIG. 18 is an illustration showing an electric winding formed directly on the magnetic core according to a preferred embodiment of the invention.

In accordance with the preferred method, two electric windings 230 and 232 are placed around the magnetic core 220. In a preferred embodiment, the electric windings 230 and 232 are formed by winding a coil of wire on a spindle (not shown), for slipping over the magnetic core 220. Alternatively, the electric windings 230 and 232 may be wound directly on the magnetic core 220, as indicated by arrow U in FIG. 18.

Advantageously, winding the electric windings 230 and 232 directly on the magnetic core 220 provides a more efficient, and thus more economical method of manufacturing by eliminating steps in the prior art manufacturing methods.

Another advantage of winding the electric windings 230 and 232 directly on the magnetic core 220 is that the windings 230 and 232 assist in binding the wires of the magnetic core 220 tightly together, thereby offering several mechanical and electrical advantages. These advantages include tighter magneto-electric coupling and greater control of vibrational noise from the core.

Figure 19:
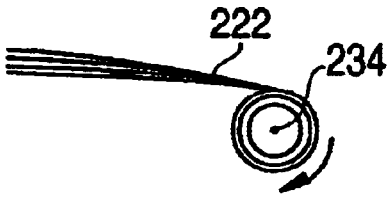
FIGS. 19 and 20 are illustrations for explaining an alternative embodiment of a method for forming a magnetic core by winding one or a plurality of wires on a spindle, and severing the wound wires to form the core.
Figure 20:
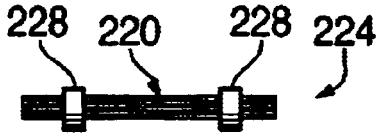

FIG. 19 illustrates an alternative method for forming a bundle of wires 224, a portion of which may be used as the magnetic core 220 in accordance with the present invention. Feeding one wire or a plurality of wires 222 to a winder 234 forms the bundle 224. However, one may also use a variety of wires having different cross-sections (e.g., different diameters, cross-sectional shapes, or cross-sectional areas) the wires being geometrically sized and arranged to be densely packed. The plurality of wires are removed from the winder 234, severed at a predetermined length to form the bundle 224, and straightened as shown in FIG. 20. By appropriately deforming the wound wires before severing, the ends will be substantially square. As in the preferred method shown in FIG. 17, bands 228 or the like hold the bundle of wires 224 together thus forming the magnetic core 220.

Figure 21:
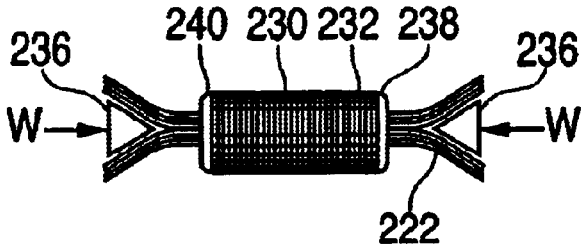
FIG. 21 is an illustration for explaining a method including extending the plurality of wires over the electric windings to envelop the windings in accordance with a preferred embodiment of the present invention.

With the electric windings 230 and 232 in place around the magnetic core 220, the next step in the preferred method includes placing at least one biassing magnet adjacent the plurality of wires. In this embodiment, two biassing magnets 238 and 240 are placed at opposite ends of the core 220. The biassing magnets 238 and 240 are permanent magnetic rings. Preferably, the plurality of wires are threaded through center holes of the biassing magnets 238 and 240 as shown in FIG. 21.

A preferred method includes configuring the plurality of wires 222 to substantially encircle the windings 230 and 232 and the biassing magnets 238 and 240. FIG. 21 illustrates one exemplary manner of encircling the plurality of wires 222 around the windings 230 and 322 and the magnets 238 and 240. The opposite ends of wires 222 are initially spread by using a pair of cones 236 to force the wires generally radially. The cores are moved toward one another as shown by arrows W. Any conventional means may then be used to finish configuring the wires 222 around the electric windings 230 and 232, as generally shown in FIG. 1.

Those skilled in the art will recognize that the magnetic core of an inductive device preferably forms a complete magnetic circuit. In a preferred embodiment, with the plurality of wires substantially encircling the electric windings and the magnetic element(s), the ends of the wires substantially meet. In other embodiments, the ends may overlap. In accordance with a preferred embodiment, the wires are preferably prepared by having their ends cleaned; then, when the ends of the wires meet, they are held together by band or other means of connection. Alternatively, the band may be used in conjunction with or be replaced by a fine iron or steel wire wrapped transversely around the device or around the wires adjacent a top or bottom of the device.

The plurality of wires form an electromagnetic shield. The device made in accordance with a method of the present invention may therefore be used in electrically noisy environments without adversely affecting or being adversely affected by surrounding components.

It will be understood that the present invention provides a highly efficient method for making an inductive device and a highly efficient inductive device. In addition, the utilization of a magnetic element with a wire core inductive device adds a bias to the generated magnetic flux, thus allowing for higher levels of alternating current before saturation occurs when operating in an environment, which includes a direct current component.

While the aforementioned embodiments include biassing magnets that are permanent magnets, it should be appreciated that any of the biassing magnets of this invention may be a permanent magnet or an electromagnet, as well as a plurality of and/or combination of the foregoing.

It should also be appreciated that any of the biassing magnets in the aforementioned embodiments may be affixed or attached to the inductive devices in a variety of manners, including but not limited to: a band, a wire, an adhesive, or other matrix material, or any other suitable means. The matrix may include magnetic particles such as a magnetically active powder. When a matrix material having magnetic particles is used, it may be desirable to energize the winding(s) with a dc current to orient the particles prior to hardening of the matrix material.

Further, it should be appreciated that although the foregoing embodiments illustrate inductive devices that are transformers, it should be appreciated that the invention is not limited to transformers.

It should be appreciated that the shape of the inductive device according to this invention is not limited to the generally cylindrical shape of the illustrative embodiments. An inductive device according to this invention may be of any shape suitable for a specific application.

The foregoing descriptions of preferred embodiments of the invention have been presented for purposes of illustration and description. The descriptions are not intended to be exhaustive or to limit the invention to the precise forms disclosed. Obvious modifications, variations or combination of embodiments are possible in light of the above teachings. The preferred embodiments were chosen and described to provide an illustration of the principles of the invention and its practical application to thereby enable one of ordinary skill in the art to utilize the invention in various embodiments and with various modifications as are needed for the particular use contemplated. Various changes may be made without departing from the spirit and scope of this invention.

What is claimed is:

1. An inductive device comprising:

a magnetic core including a portion of a plurality of wires;

at least one electric winding extending around said magnetic core, each of said plurality of wires at least partially encircling said at least one electric winding and completing a magnetic circuit; and at least one biassing magnet disposed adjacent said plurality of wires and applying a magnetic bias to said magnetic circuit.

2. An inductive device as recited in claim 1, wherein said biasing is a permanent magnet.

3. An inductive device as recited in claim 1, wherein at least one of said plurality of wires substantially encircles said biassing magnet.

4. An inductive device as recited in claim 1, wherein said biassing magnet is disposed at an end of the inductive device.

5. An inductive device as recited in claim 1, wherein said biasing magnet is disposed at an end of said magnetic core.

6. An inductive device as recited in claim 5, wherein at least one of said plurality of wires substantially encircles said biassing magnet.

7. An inductive device as recited in claim 1, further comprising a second biassing magnet, wherein said one biassing magnet and said second biassing magnet are disposed at opposite ends of said magnetic core.

8. An inductive device as recited in claim 7, wherein at least one of said plurality of wires substantially encircles said biassing magnet and said second biassing magnet.

9. An inductive device as recited in claim 1, wherein said biassing magnet is a hollow cylinder substantially encircling said plurality of wires.

10. An inductive device as recited in claim 1, wherein said biassing magnet is disposed adjacent said magnetic core.

11. An inductive device as recited in claim 1, wherein said biassing magnet is a hollow cylinder substantially encircling a portion of said magnetic core.

12. An inductive device as recited in claim 1, wherein said biassing magnet is a hollow cylinder substantially encircling said magnetic core.

13. An inductive device as recited in claim 1, wherein said biassing magnet is disposed among said portion of said plurality of wires of said magnetic core.

14. An inductive device as recited in claim 10, wherein said biassing magnet is a cylindrical.

15. An inductive device as recited in claim 1, wherein said plurality of wires include wires of different cross-sections arranged to increase the density of said magnetic core.

16. An inductive device as recited in claim 1, wherein said plurality of wires substantially envelop said at least one electric winding to provide shielding from electromagnetic fields.

17. An inductive device as recited in claim 1, wherein each of said plurality of wires includes a first end and a second end that substantially abut one another.

18. An inductive device as recited in claim 17, wherein said first and second ends of each wire meet.

19. An inductive device as recited in claim 17, wherein said first and second ends of each wire are secured in place.

20. An inductive device as recited in claim 19, wherein said first and second ends of said plurality of wires are secured by a band.

21. An inductive device as recited in claim 1, wherein each of said plurality of wires includes a first end and a second end that oppose one another across a gap, and said biassing magnet is disposed adjacent said gap.

22. An inductive device as recited in claim 21, wherein said biassing magnet is received in said gap.

23. An inductive device as recited in claim 1, further comprising a mounting post disposed among said plurality of wires and extending from said plurality of wires.

24. An inductive device as recited in claim 23, wherein the mounting post extends from said plurality of wires only at one end of the inductive device.

25. An inductive device as recited in claim 1, further comprising a second electric winding extending around said magnetic core.

26. An inductive device as recited in claim 25, wherein said second electric winding is axially displaced from said at least one electric winding.

27. An inductive device as recited in claim 25, wherein said second electric winding is arranged concentrically with said at least one electric winding.

28. An inductive device as recited in claim 1, wherein said at least one electric winding is in direct contact with said magnetic core.

29. An inductive device as recited in claim 1, wherein said plurality of wires are electrically insulated from one another.

30. A method for making an inductive device, comprising:

providing a magnetic core including a portion of a plurality of wires, arranging at least one electric winding around the magnetic core;

configuring each of the plurality of wires so as to at least partially encircle the at least one electric winding and complete a magnetic circuit; and providing at least one biassing magnet adjacent the plurality of wires to apply a magnetic bias to said magnetic circuit.

31. A method as recited in claim 30, wherein at least one of said plurality of wires substantially encircles said biassing magnet.

32. A method as recited in claim 31, wherein said biassing magnet is disposed at an end of said magnetic core.

33. A method as recited in claim 30, wherein said biassing magnet is disposed at an end of said inductive device.

34. A method as recited in claim 30, further comprising providing a second biassing magnet, wherein said biassing magnet and said second biassing magnet are disposed at opposite ends of said magnetic core.

35. A method as recited in claim 34, wherein at least one of said plurality of wires substantially encircles said one biassing magnet and said second biassing magnet.

36. A method as recited in claim 30, wherein the plurality of wires include wires of different cross-sections arranged to increase the density of the magnetic core.

37. A method as recited in claim 30, wherein said configuring includes substantially abutting first and second ends of each of the plurality of wires.

38. A method as recited in claim 30, wherein said configuring includes securing first and second ends of each of the plurality of wires in place.

39. A method as recited in claim 38, wherein said securing includes wrapping a band around the plurality of wires.

40. A method as recited in claim 38, wherein said biassing magnet is a permanent magnet.

* * * * *